US006402600B1

(12) United States Patent
Besch

(10) Patent No.: US 6,402,600 B1
(45) Date of Patent: Jun. 11, 2002

(54) BOWLING BALL SURFACE ABRADING AND POLISHING TOOL ASSEMBLY

(76) Inventor: Othmar C. Besch, 10379 Mary Ave., Cupertino, CA (US) 95014-1342

( * ) Notice: Subject to any disclaimer, the term of this patent is extended or adjusted under 35 U.S.C. 154(b) by 0 days.

(21) Appl. No.: 09/703,222

(22) Filed: Oct. 30, 2000

(51) Int. Cl.[7] ..... B24D 7/18; B24B 11/10
(52) U.S. Cl. ..... 451/268; 451/548
(58) Field of Search ..... 451/50, 268, 548, 451/557, 42, 277

(56) References Cited

U.S. PATENT DOCUMENTS

| | | | | |
|---|---|---|---|---|
| 1,604,517 A | * | 10/1926 | Jolls | 451/548 |
| 2,982,057 A | * | 5/1961 | Stanhope | 451/50 |
| 3,016,662 A | * | 1/1962 | Ellis | 451/548 |
| 3,024,578 A | | 3/1962 | Mushkin | |
| 3,133,383 A | | 5/1964 | Chapman | |
| 3,961,448 A | | 6/1976 | Akahane | |
| 3,971,164 A | | 7/1976 | Albin | |
| 4,001,981 A | * | 1/1977 | Wood | 451/548 |
| 4,856,231 A | | 8/1989 | Kusser | |
| 5,484,329 A | | 1/1996 | Engelbretson | |
| 5,613,896 A | | 3/1997 | Haus | |
| 5,658,188 A | * | 8/1997 | Yamada et al. | 451/50 |

* cited by examiner

*Primary Examiner*—Robert A. Rose

(57) ABSTRACT

This invention consists of a two-component cylindrical tool assembly suitable for contour rough abrading, texturing, fine surface abrading and extra fine polishing of a spherical surface. The tool body, fabricated from a rigid material, is smaller in diameter than the spherical object being abraded. The abrading cylindrical component, made from a molded and cured thermosetting resin material, is filled with diamond abrasive particles. The two components are assembled with their axis of rotation concentric with each other. The amount of surface abrasion and quality of surface finish imparted to the object during the operation is directly related to particle size, uniformity of size, quantity of the abrasive particles used, and the uniformity of their dispersion throughout the molded abrading cylinder. The cylinder face that extends beyond the body component is machined to match the spherical radius of the bowling ball or similar object, defining the annular region of spherical contact. Surface abrasion between the invention and spherical object occurs when the invention is rotating and the object is either held stationary or is rotating. Surface abrasion will also occur when the spherical object is rotating and the invention is not rotating but traversed across the object's rotating surface, perpendicular to the rotational direction. Machined holes on the body face opposite the abrading cylinder adapt the invention for various mechanical or hand tool options.

13 Claims, 7 Drawing Sheets

BOWLING BALL SURFACE ABRADING AND POLISHING TOOL ASSEMBLY

BACKGROUND OF THE INVENTION

This invention relates generally to contour rough abrading, texturing fine abrading, and extra fine polishing of spherical surfaces utilizing the hardness and sharp irregular edge characteristics of crystalline diamond particles. Diamond particles of a specific uniform size are dispersed throughout a non-metallic thermosetting resin material that is molded and cured into a thin wall, cylindrical configuration and mounted to a rigid material tool body. More particularly this invention is adaptable to spherical contouring, surface texturing, finishing and polishing a bowling ball by being used as a non-rotating device on a rotating spherical surface or as a rotating device on either a rotating or non-rotating spherical surface.

Bowling ball performance is dramatically affected by the surface condition of the bowling lane. The light, medium or heavy oil content applied by a Bowling Center's maintenance crew to the surface of the bowling lane affects the spin physics and performance of a bowling ball. To counteract the bowling lane conditions, serious bowlers use specific surface textures and finishes on the surface of their bowling balls. They also require the ball to have a close tolerance spherical radius for optimized bowling ball performance.

Extensive usage causes a bowling ball to become grooved on the surface from the repeated sliding along the lane. When this takes place, the ball becomes out-of-round and needs to be resurfaced with a new spherical radius. Another out-of-round situation occurs when plugging existing finger holes. This operation leaves excess material on the surface of the ball that must be blended with the object's surface and made to conform to the object's spherical radius.

The concept of resurfacing and refinishing the surface of bowling balls is not new. The previously mentioned problems are old ones and have been addressed often. For surface maintenance, tools made according to this invention's specification would contain fine or extra fine abrasive particles of a size sufficient to remove scratches and polish the bowling ball. For major resurfacing, tools would contain coarse abrasive particles of a size suitable to remove larger surface imperfections. To restore a bowling ball manufactured with a textured surface, tools would contain medium size abrasive particles of a select size.

The abrading cup applications discussed in the following patent literature can be replaced with a cup or cups designed and manufactured according to this invention, simplifying and improving the efficiency of bowling ball surface manufacture, repair or surface maintenance while maintaining bowling ball sphericity.

U.S. Pat. No. 3,024,578 shows a complete machine having two, integral rotating abrading cups fitted with a conical, replaceable abrasive element in each cup, contacting the spherical surface as a circular line. The replaceable abrasive element supported by each cup initiates the abrading action on the surface of the ball until the abrasive media is worn from the element and requires replacement.

U.S. Pat. No. 3,133,383 shows a complete machine having three integral rotating abrading cups contacting a bowling ball in a circular surface pattern, i.e., a line or zonal surface contact used to grind, lap, and polish the surface of a spherical or truncated spherical ball. An external grinding or lapping compound is applied to the ball, causing the internal surfaces of the cups to grind and lap the ball in the region of contact.

U.S. Pat. No. 3,961,448 shows a complete machine having three integral rotating abrading cups contacting the spherical surface as an annular contact surface along the circular brim of the polishing cup. Before the polishing cups are able to initiate the abrading action on the body surface, an abrasive compound or abrasive slurry must be applied externally to the object.

U.S. Pat. No. 3,971,164 shows a bowling ball resurfacing machine where a series of rollers on a sliding table support the bowling ball while it is brought against a rotating flat disk fitted with an abrasive sanding media making a point contact on the surface of the ball. The ball is moved laterally to the sanding disk and then manually rotated to abrade the ball surface. The flat rotating sanding disk abrades the object's surface as a point contact.

U.S. Pat. No. 4,856,231 shows a machine for grinding large balls in which a motor rotates the ball against a dish-shaped grinding tool located on top of the ball. An abrasive agent is supplied externally through the central opening of the grinding tool.

U.S. Pat. No. 5,484,329 shows a non-rotating, multicavity handheld tool with a hook and loop system to attach abrasive pads for sanding and polishing the surface of a rotating bowling ball. This pliable system, using replaceable abrasive pads, polishes the surface of the object while following the contour of the ball. Since it is a pliable system, the tool follows the rises and depressions on the ball surface and does not make the ball spherical if it is out of round.

U.S. Pat. No. 5,613,896 shows a bowling ball resurfacing machine with three integral rotating, grinding and lapping cups, each having an interior conical surface. Industrial diamond particles are nickel electroplated to the conical, annular ring that contacts the spherical surface as a circular single line.

U.S. Pat. No. 1,604,517 shows an annular body groove and a ring assembly for locating and clamping the abrasive grinding member to the tool body. "The tapered cross section of the grinding member makes it suitable for operation on generated involute gear teeth" which in turn subjects the grinding member to external bending forces. A larger annular mounting surface on the abrasive member is required to counteract the induced member forces encountered during grinding on the converging abrading surfaces. The added surface becomes suitable for clamping and replacing the member on the tool body.

U.S. Pat. No. 3,016,662 shows a honing element with a concave abrading face. The abrasive-filled honing member is friable in nature, made from a vitrified material that easily abrades and conforms to the configuration of the object during the honing operation. Concentric inner and outer annular supporting cylinders are required to reinforce and support the frangible abrasive element during the honing operation.

U.S. Pat. No. 5,658,188 shows a tool assembly with a circular grinding face extending outward and spreading toward the outside tool diameter having a uniform layer of abrasive grains bonded to the planar facial surface. During operation the abrasive surface on the tool is tangent to the spherical surface of the object being ground, and the radius of curvature of the tool is greater than the object's radius. The slits disposed on circumferential spacing about the grinding faces help to expel the shavings but can be omitted as stated in the patent description.

U.S. Pat No. 2,982,057 shows two concepts of abrading tools used to achieve a honing effect by removing a minimum amount of material from a hard surface of a pre-ground frusto-spherical steel object. The first concept shows a hollow cylindrical member formed from an abrasive material; the tool is formed into a concave surface at its abrading end. During the honing operation, the abrading surface engages the spherically shaped object and polishes it. The second concept is a hollow cylindrical member of a hard cutting material formed at one end with spaced teeth having inwardly inclined working surfaces. The conic working surfaces of the teeth are tangent to the surface of the pre-machined spherical shaped object. In cross sectional view the point of contact between tool face and object moves upward along the surface of the inclined tool face as the tool is fed into the object. Honing stops as the object attains the required surface finish.

U.S. Pat. No. 4,001,981 shows a cup-shaped grinding wheel consisting of an annular conic-shaped, abrasive-filled ring of uniform thickness secured to the outside of an interior non-abrasive porous resin member. This assembly is secured to an annular support member. The finished grinding wheel is a typical configuration suitable for flat surface material removal.

BRIEF SUMMARY OF THE INVENTION

This invention provides a tool assembly for abrading the spherical surface of a bowling ball designed to satisfy the aforementioned needs while maintaining the object's spherical radius. The tool assembly is composed of two cylindrical components: a tool body and an abrasive-filled resin cylinder. The tool body is smaller in diameter than the spherical object being abraded and is fabricated from a hard rigid material. The diamond particle-filled, thin wall cylinder is smaller in diameter than the tool body and made from a molded and cured thermosetting resin material. The two components of the invention are assembled with their axis of rotation concentric with each other, and the abrasive-filled cylinder is located and fastened in the tool body groove whose cylinder height is greater than the depth of the body groove, resulting in one end of the cylinder extending beyond the tool body face. The extended cylinder face is machined to match the spherical radius of the object being abraded and cut in a radial direction across the cylindrical wall thickness to divide the face into circular arc segments. Cutting the circular face of the abrasive cylinder into two or more segments becomes necessary to wet the diamond abrasive cutting surface and to provide flow paths for excess coolant, lubricant and surface residue to drain from the tool body cavity area during operation. The coolant and lubricant application itself is a processing requirement when abrading and polishing spherical surfaces and is not part of this invention.

The physical average particle size of the diamond or other abrasive media dispersed throughout the molded and cured tool cylinder is sized for the particular abrading action being accomplished. The coarser particles are classified as mesh sizes (specification ANSI 1374 16) and the finer particles are classified as powder in micron sizes (specification ANSI B74.20). Size ranges, for example, include but are not limited to: coarse particles 30 to 230 U.S.A. mesh size for contour abrading, medium size particles 230 to 700 U.S.A. mesh size for surface texturing, fine powders 25 to 6 microns for fine surface finishing, and extra fine powders 6 to 1 micron for polishing the spherical surface of a bowling ball.

The tool body face opposite the abrasive-filled cylinder has machined holes to adapt the invention for various methods of usage including but not limited to the following: a handle fastened to the tool body face for manual handheld abrading actions, an adapter shaft fastened to the tool face for attaching a drill motor for rotational abrading, or a flange fastened to the tool body for adaptation to a powered drive shaft used on bowling ball surfacing machines. More importantly the invention is a tool assembly that will abrade and restore the surface of a bowling ball to the required manufacturer's specification or customer's requirements without loss of its sphericity when used in one of the methods described.

BRIEF DESCRIPTION OF THE DRAWINGS

In the following Detailed Description of the Invention, reference will be made to the attached drawings in which.

DETAILED DESCRIPTION OF THE INVENTION

This invention will be described with reference to the individual drawings and their numbered parts. The description is meant to be illustrative of the invention and not limiting it to the particular construction shown and described.

Figure 1:
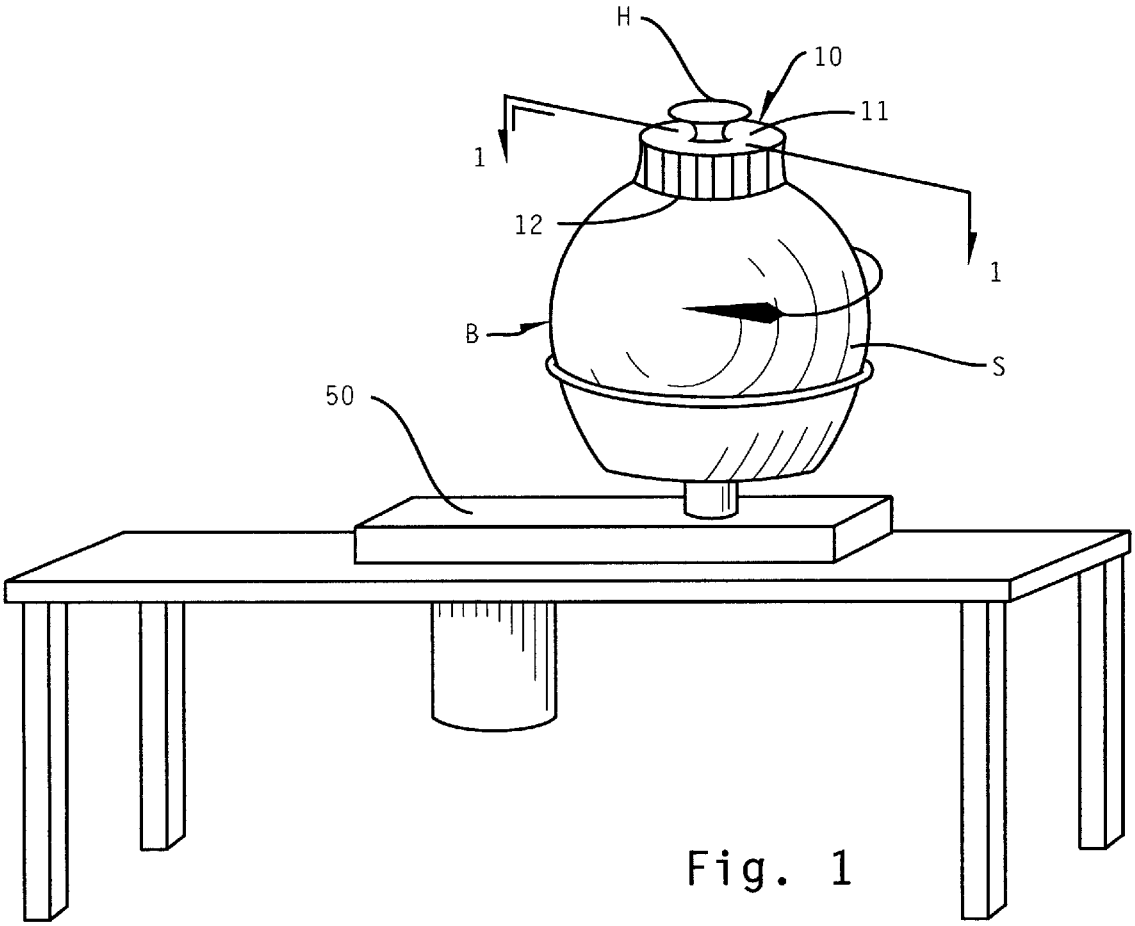
FIG. 1 shows a perspective view of the side elevation of the invention with handle attached, positioned on top of a rotating bowling ball that is held firmly in a motorized rotating polishing machine. The abrading action between the contact surface of the non-rotating invention and the rotating bowling ball takes place as the operator applies pressure to the handle and moves the invention along the surface of the rotating bowling ball perpendicular to ball rotation. A diametrical cross section 1—1 is shown taken across the upper face of the tool body.
Figure 9:
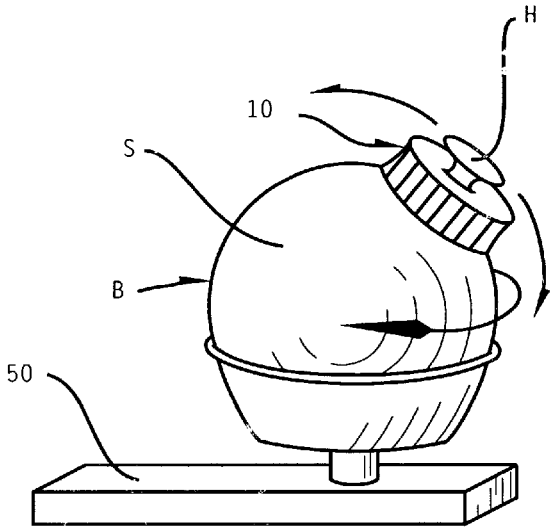
FIG. 9 shows a profile view of this invention adapted for use as a non-rotating, handheld device.

FIG. 1 shows a perspective view of the invention 10 positioned on the surface S of a rotating spherical object B. The abrading and polishing tool assembly 10 consists of two detail parts, 11 and 12, comprising the preferred embodiment of the present invention that is specifically adapted for abrading and polishing the surface of a bowling ball. The tool assembly 10 is used to abrade the spherical surface of the bowling ball as the latter is positioned and rotated in a conventional motorized ball spinner machine 50. The handle H is shown attached to the tool assembly to illustrate a method in the use of this invention. Operator hand pressure is applied to the handle, preventing rotation of the tool assembly 10 and controlling the amount of abrading action the tool assembly imparts to the surface of the bowling ball. During the abrading cycle the invention is traversed manually across the surface perpendicular to the bowling ball B rotation as shown in FIG. 9.

Figure 2:
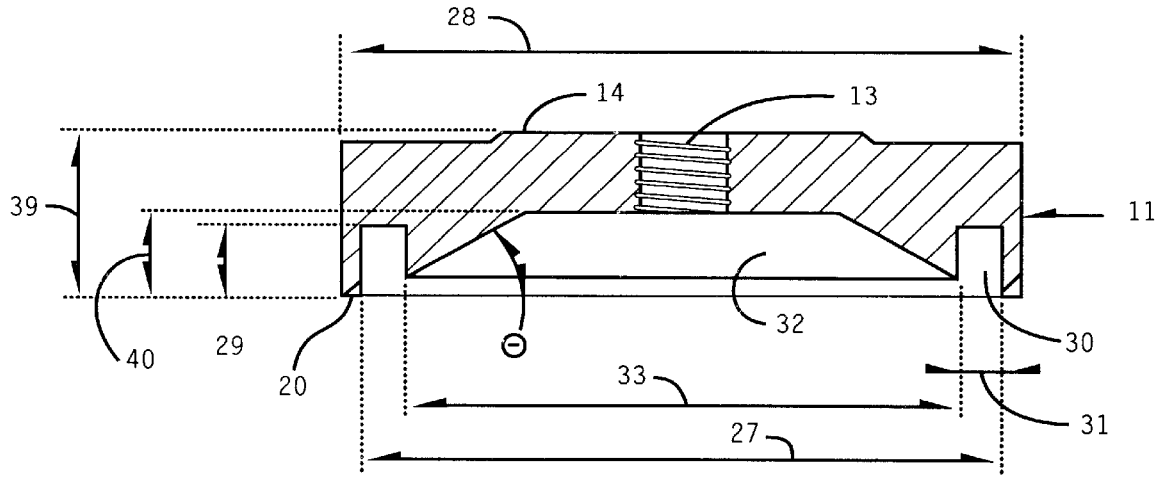
FIG. 2 is an explanatory sectional view of the tool body detail taken from the diametrical cross sectional view 1—1, FIG. 1.
Figure 3:
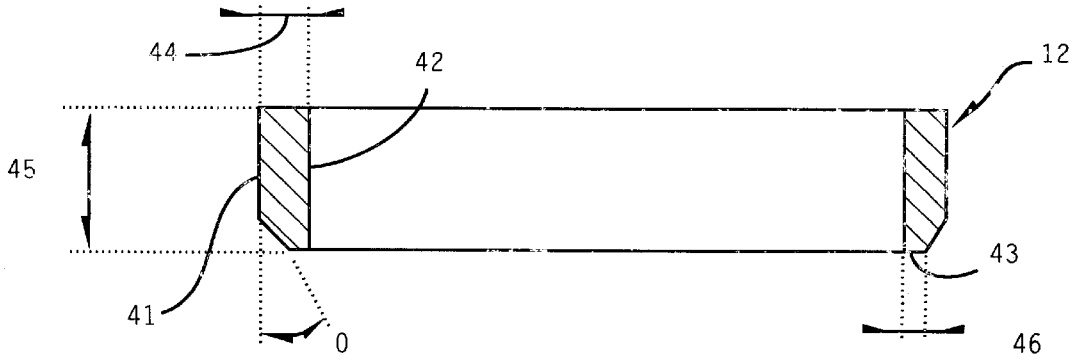
FIG. 3 is an explanatory sectional view of the molded, abrading cylinder detail taken from the diametrical cross sectional view 1—1, FIG. 1.

FIGS. 2–3 show the individual components 11 and 12 as details of the invention taken from cross section 1—1 in FIG. 1. The tool body component 11 is fabricated from either wrought or cast metallic material or from a rigid non-metallic material. Threaded holes 13 are shown on the face 14 enabling the invention to be adapted in various ways for use in manual, semi-automatic or fully automatic surface abrading applications. A groove is machined into the tool body, starting at the face 20 with a maximum diameter 27 and a minimum depth 29 that is twice the groove width 31.

The tool component 12 is an abrasive-filled, thin wall cylinder with parallel faces, molded and cured from thermosetting resin material. It is filled with uniform abrasive particles of a specific size, such as diamond, aluminum oxide, silicon carbide or cubic boron nitride. The cylinder is positioned in the tool body groove 30 and fastened to the body, either by mechanical or chemical-adhesive methods. The outside diameter 41 of the cylinder 12 is molded slightly smaller than the major diameter 27 of the body groove. The inside diameter 42 of the cylinder is molded slightly larger than the diameter 33 of the body groove, providing easy installation and attachment of the abrading cylinder into the tool body groove. The axial length 45 of the molded cylinder 12 is a minimum of three times the width of the cylindrical wall thickness 44. A minimum 26 degree outside edge chamfer angle Phi measured from the cylinder face 43, starting at one half the cylinder wall thickness 46 and extending to the outside circumferential surface 41, is formed as part of the molded abrasive cylinder shown in FIG.3. The chamfer area 58, shown in FIGS. 6 and 7, minimizes the sharpness of the cylinder's outer circumferential edge as the facial surface wears from the abrading action.

Figure 8:
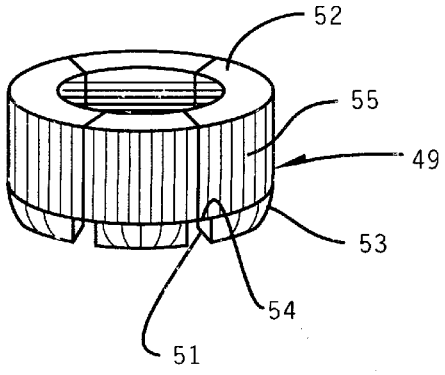
FIG. 8 shows a perspective view of assembled, molded or machined abrasive-filled component details forming a cylinder when placed side by side.

Identical individual cylindrical arc sections 49 shown in FIG. 8 can be used as an alternate design for the one-piece cylindrical abrasive component 12. This type of construction does not change the intent of the invention or the function of the abrading action described for the one-piece cylinder 12. A thin wall abrading cylinder is formed by placing several individual abrasive-filled cylindrical arc sections side by side in the tool body groove 30 and fastening them to the tool body 11 either by mechanical or adhesive methods. A minimum 26 degree outside edge chamfer angle measured from the cylinder face 51, starting at one half the cylinder wall thickness and extending to the outside circumferential surface 55, is formed as part of the molded abrasive cylinder segment 49 shown in FIG.8. Each individual section has a minimum axial length of three times the thickness 52 of the cylinder segment. When assembled in the tool body groove, the cylinder segment extends beyond the tool body face 20 at the beginning of the chamfer area 53. The individual segments are molded or machined with an equal undercut area 54 on each side of the extended part of each cylindrical section.

Figure 6:
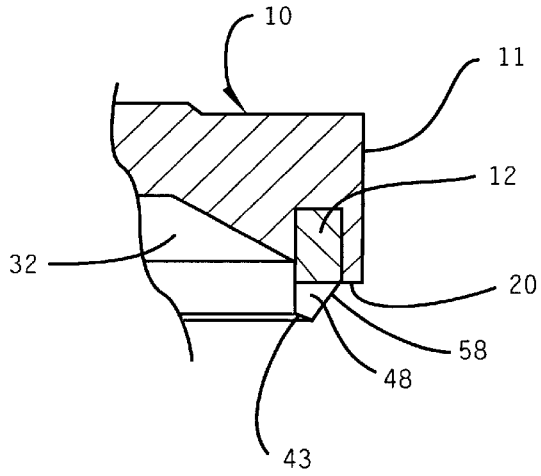
FIG. 6 is a detail of view 2—2 taken in FIG. 5. It shows the maximum depth of the radial cut across the cylinder at tool body face 20.
Figure 7:
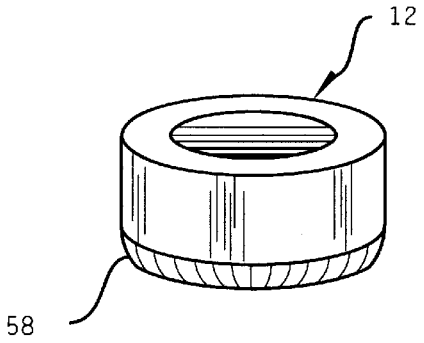
FIG. 7 shows a perspective view of the one-piece, abrasive-filled cylinder in an as-molded and cured condition.

After fastening the one-piece cylinder 12 or multiple cylinder arc sections 49 to the tool body, the dimensional spherical radius of the object to be abraded is machined on the extended facial surface 43 of the cylinder component 12, shown in FIG. 6, or facial surface 51 of each individual circular section component 49, shown in FIG. 8. The only portion of the components 12 and 49 that come in contact with the spherical surface of the object being abraded is the extended face 43 and 51 respectively for each design.

The contact area between the invention and object is a thin, annular-segmented surface on the extended face of the abrasive-filled cylinders or sections. All abrading action is concentrated in this area and uniformly performed over the entire object with a nearly equal circular velocity at each spot on the annular contact surface of said cylinder. As the abrasive-filled cylinder segments fully contact the object's surface, the centerline of the cylinder continually intersects the center of the spherical object, maintaining the object's sphericity.

Figure 4:
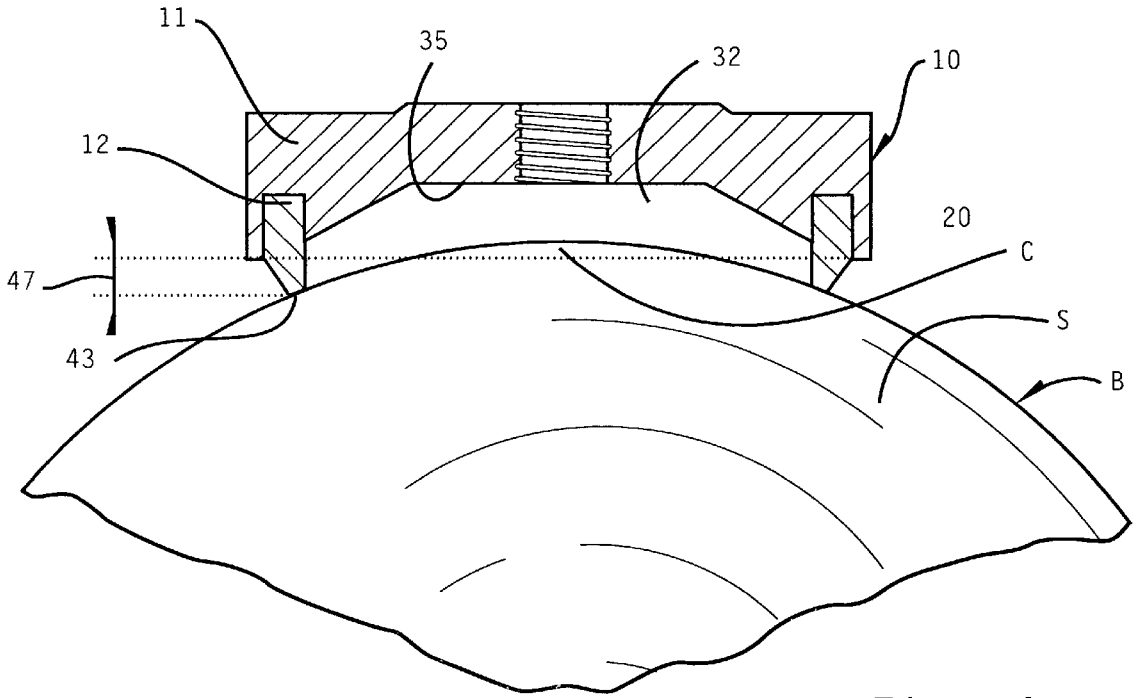
FIG. 4 is an explanatory sectional view of the complete invention resulting from the diametrical cross sectional view 1—1, FIG. 1, showing the tool body and the molded diamond particle-filled abrading cylinder installed in the tool body groove. The spherical radial configuration of the object being abraded is shown machined on the face of the extended cylinder.

A central body cavity, illustrated in FIG. 4, either conical, shown as item 32, or spherical, extends between the inside diameter of the installed abrasive-filled cylinder 12 and the body interior surface 35, providing clearance for the object's spherical surface. The cavity's conical base, depicted in FIG. 2, lies between the inside diameter 33 of the groove 30 and the plane of the body face 20. The base diameter of the conic cavity shown starts along the face 20 equal to the minimum groove diameter 33 plus one groove width 31 with a minimum base angle Theta of 30 degrees. The body cavity depth 40 is not greater than three-fourths the body thickness 39 and lies inside the small diameter of said abrasive-filled cylinder. The body cavity 32 does not come in contact with the object's surface and is not a contact abrading surface.

Figure 5:
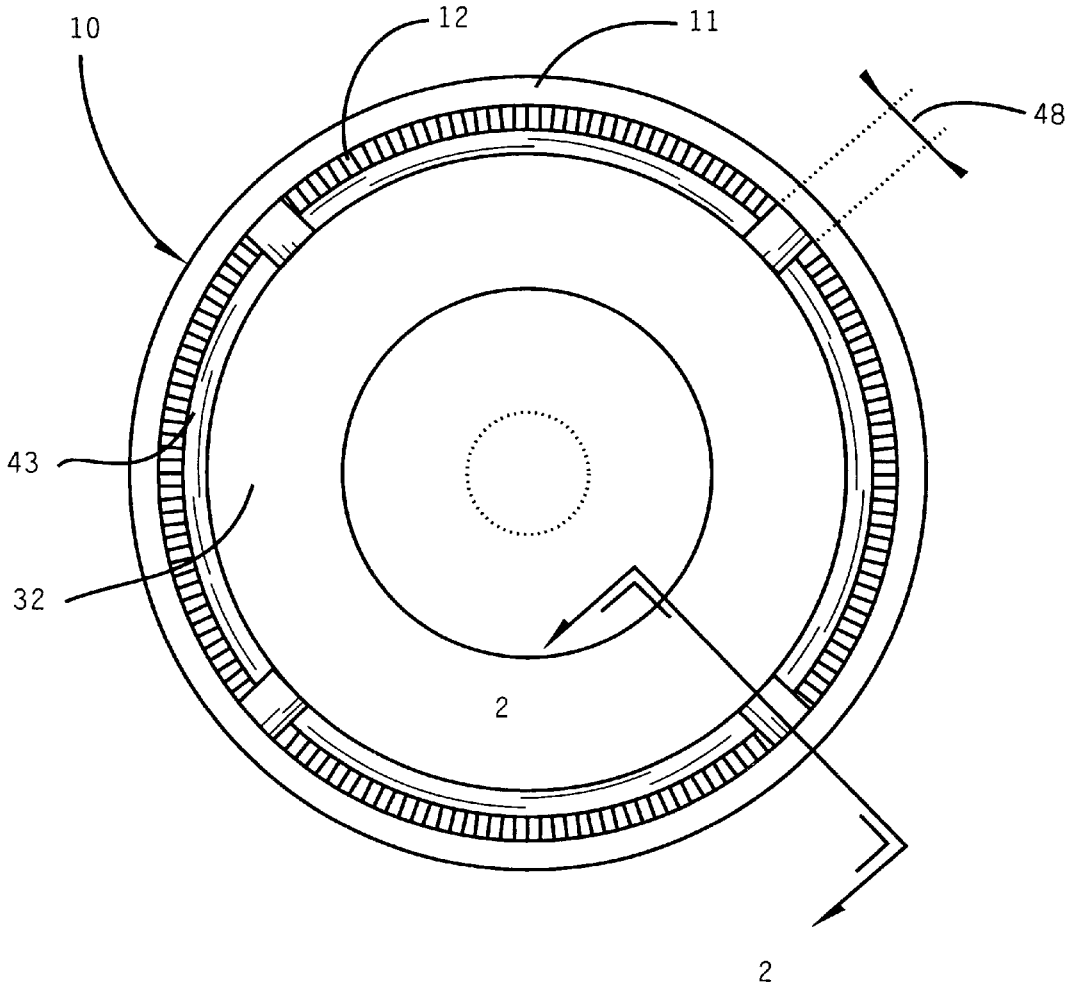
FIG. 5 is an explanatory view looking into the body cavity, showing radial machine cuts across the face of the abrading cylinder installed in the tool body. Each radial cut proportions the abrasive cylinder face into an abrasive segment.

Detail component 12 in the plan view of the invention shown in FIG. 5 shows the relationship of the installed cylinder and the machine cuts across the cylinder forming arc segments. At least two, but not limited to two, radial machine cuts 48 are required, machined to a maximum depth 47 without penetrating the plane of the tool body face 20. The machined cuts provide flow paths for coolant to wet the abrasive cylinder's cutting surface and to remove excess coolant and surface residue from the cavity of the tool body. Four radial cuts are shown in FIG. 5, forming four segmented abrading surfaces on the face of the cylinder component 12.

The machined spherical curvature of the abrasive areas 43 and 51 on the face of the particle-filled cylinder 12 and 49, illustrated in FIGS. 4 and 8, are maintained while abrading the object. This occurs as a result of slight erosion of the cylinder resin material, some loss of the embedded abrasive particles and the surface material being removed from the object. This tool provides uniform pressure on the object as the tool's abrading surface contacts the ball, resulting in optimum grinding and polishing results.

Figure 10:
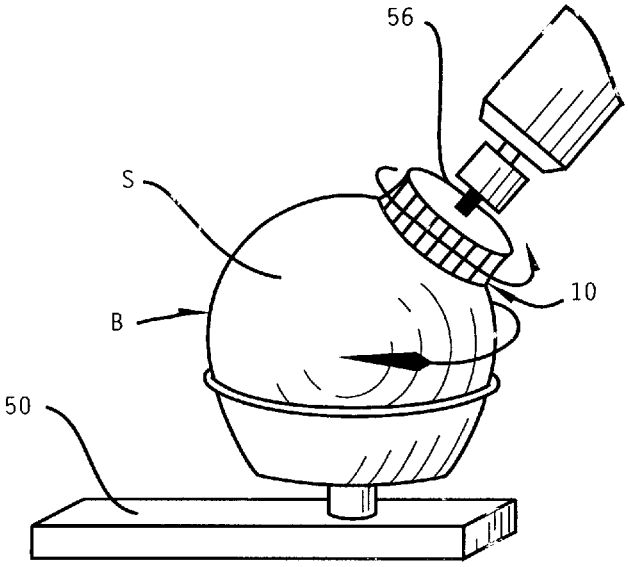
FIG. 10 shows a profile view of this invention adapted for use with a drill motor capable of rotating the invention.

A standard adapter 56 shown in FIG. 10 having a screw thread on one end and a circular stub shaft on the other can be used to adapt the invention 10 for use in selective surface abrasion rework using a rotating power source such as a powered drill motor. The bowling ball can either be rotating or held stationary while the invention is rotated by a drill motor, blending the surface rework area to the bowling ball's spherical radius.

Figure 11:
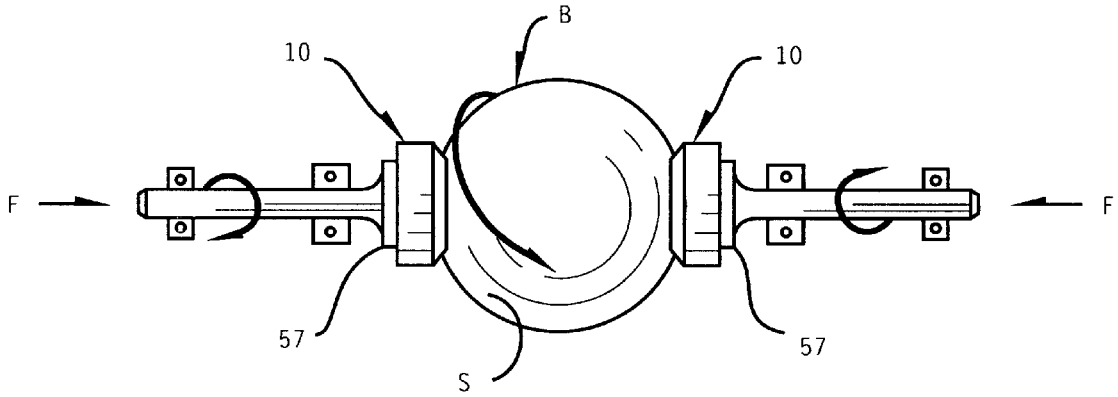
FIG. 11 shows a profile view of this invention adapted for use with a powered, rotating drive shaft mounted on a bowling ball surface-finishing machine.

The invention 10 shown in FIG. 11 can be fastened to the flanged end of a bearing supported powered drive shaft 57 found on commercial surfacing machines. The controlled machine force F transmitted to the invention by at least one drive shaft regulates the amount of abrading action taking place at the interface of the cylinder face 43 or 51 and the surface of the object, as both the invention and the bowling ball rotate. This application abrades and polishes 100% of the bowling ball surface, maintaining its spherical radius.

This invention, a tool assembly composed of two cylindrical components—a tool body and an abrasive-filled resin cylinder, is particularly adapted to precisely abrade and polish the spherical surface of a bowling ball while maintaining its spherical radius curvature. While the invention has been described in this section, it is not to be limited by this description but rather in accordance with the spirit and scope of the appended claims.

What I claim as my invention is:

1. A versatile tool assembly for spherical contouring, surface texturing, finishing and polishing the spherical surface of a bowling ball or similar object, consisting of:

(a) a tool having a body fabricated from a rigid-type material;

(b) a body circular in shape with the diameter wider than its height;

(c) a cylindrical groove fabricated on one face of the body having the groove width less than one half the groove depth;

(d) the body material between the inside diameter of the groove, formed into a spherical depression, having a depth not greater than three-fourths of the body height;

(e) a one piece abrasive-filled thin wall cylinder with parallel faces fabricated from molded and cured thermosetting resin material, located in the groove and fastened to the tool body;

(f) a spherical radius machined on the face of the cylinder matching the spherical radius of the bowling ball being abraded; and (g) holes machined into the body face opposite the abrading cylinder allowing the tool to be used in different methods of operation.

2. The tool assembly of claim 1 where an alternate design is a cylinder formed by locating and fastening cured abrasive-filled thermosetting resin cylindrical sections side by side in the tool body groove.

3. The tool assembly of claim 1 where a cylinder filled with uniform coarse diamond particles in the 30 to 230 U.S.A. mesh size (ANSI 1374 16) range dispersed throughout the cylinder for contour rough abrading the spherical surface of a bowling ball.

4. The tool assembly of claim 1 where a cylinder filled with uniform medium fine diamond particles in the 230 to 700 U.S.A. mesh size (ANSI 1374 16) range dispersed throughout the cylinder for texturing the spherical surface of a bowling ball.

5. The tool assembly of claim 1 where a cylinder filled with uniform fine diamond powder in the 25 to 6 micron (ANSI B74.20) range dispersed throughout the cylinder for fine abrading the spherical surface of a bowling ball.

6. The tool assembly of claim 1 where a cylinder filled with uniform extra fine diamond powder in the 6 to 1 micron (ANSI B74.20) range dispersed throughout the cylinder for extra fine polishing the spherical surface of a bowling ball.

7. The tool assembly of claim 1 where a molded, abrasive-filled cylinder whose height is greater than the groove depth in the tool body causing part of the cylinder to extend beyond the face of the body.

8. The tool assembly of claim 1 where a molded, abrasive-filled cylinder having a minimum chamfer angle of 26 degrees starting on the face of the cylinder at one half of the wall thickness and extending to the outside diameter of the cylinder.

9. The tool assembly of claim 1 where a molded, abrasive-filled cylinder having multiple radial machine cuts across the cylindrical surface to a maximum depth of the tool body face, dividing the exposed cylinder face into abrasive-filled annular abrading surfaces.

10. The tool assembly of claim 1 where fabricated cylindrical sections mounted in the body groove having an undercut at each corner of the extended section define the beginning and end of the abrading surface of each segment.

11. The tool assembly of claim 1 where said body face opposite the abrasive-filled abrading cylinder is fitted with a removable handle used to hold and prevent rotation of the invention during contour rough abrading, texturing, fine abrading and extra fine polishing of a bowling ball spherical surface, as it is being rotated in a tool fixture or machine.

12. The tool assembly of claim 1 where said body face opposite the abrasive-filled abrading cylinder is fitted with a removable adapter used to attach the invention to a drill motor in order to rotate the invention while rough surface spherical contouring, surface texturing, fine surface abrading and polishing surface areas of a non-rotating bowling ball.

13. The tool assembly of claim 1 where said body face, opposite the abrasive-filled abrading cylinder is fitted to rotating power drive shafts used on commercial spherical surfacing machines for the purpose of rough contouring, surface texturing, fine surface abrading and extra fine polishing the surface of a rotating bowling ball.

* * * * *